US009428001B2

(12) United States Patent
Candela

(10) Patent No.: US 9,428,001 B2
(45) Date of Patent: Aug. 30, 2016

(54) MARKING IMPLEMENT

(71) Applicant: F.I.L.A.—FABBRICA ITALIANA LAPIS ED AFFINI S.P.A., Milan (MI) (IT)

(72) Inventor: Massimo Candela, Milan (IT)

(73) Assignee: F.I.L.A.—FABRICA ITALIANA LAPIS ED AFFINI S.P.A., Pero (IT)

( * ) Notice: Subject to any disclaimer, the term of this patent is extended or adjusted under 35 U.S.C. 154(b) by 1 day.

(21) Appl. No.: 14/303,829

(22) Filed: Jun. 13, 2014

(65) Prior Publication Data

US 2014/0369735 A1 Dec. 18, 2014

(30) Foreign Application Priority Data

Jun. 17, 2013 (EP) ..... 13425083

(51) Int. Cl.

| | |
|---|---|
| ***B43K 21/06*** | (2006.01) |
| ***B43K 21/027*** | (2006.01) |
| ***B43K 21/18*** | (2006.01) |
| ***B43K 24/08*** | (2006.01) |
| ***B43K 21/00*** | (2006.01) |
| ***B43K 23/016*** | (2006.01) |
| ***B43K 23/08*** | (2006.01) |
| ***B43K 25/00*** | (2006.01) |
| ***B43K 29/06*** | (2006.01) |
| *B43K 8/00* | (2006.01) |
| *B43L 23/00* | (2006.01) |
| *B43K 5/00* | (2006.01) |
| *B43K 7/00* | (2006.01) |

(52) U.S. Cl.

CPC ..... *B43K 21/027* (2013.01); *B43K 21/006* (2013.01); *B43K 21/18* (2013.01); *B43K 23/016* (2013.01); *B43K 23/08* (2013.01); *B43K 24/08* (2013.01); *B43K 25/00* (2013.01); *B43K 29/06* (2013.01); *B43K 5/005* (2013.01); *B43K 7/005* (2013.01); *B43K 8/003* (2013.01); *B43K 21/06* (2013.01); *B43L 23/00* (2013.01)

(58) Field of Classification Search

CPC ..... B43K 21/06
USPC ..... 401/48, 57, 56, 66, 82, 88, 89, 109, 401/110, 111, 112, 116, 117
See application file for complete search history.

(56) References Cited

U.S. PATENT DOCUMENTS

| | | | | |
|---|---|---|---|---|
| 202,654 | A * | 4/1878 | Holland | 401/82 |
| 434,781 | A * | 8/1890 | Hewitt | 15/443 |
| 561,734 | A * | 6/1896 | Steele | 401/84 |

(Continued)

FOREIGN PATENT DOCUMENTS

| | | | |
|---|---|---|---|
| EP | 1857014 | A2 | 11/2007 |
| EP | 2201859 | A1 | 6/2010 |
| GB | 2277905 | A | 11/1994 |
| WO | 2008146554 | A1 | 12/2008 |

*Primary Examiner* — Mark A Laurenzi
*Assistant Examiner* — Joshua Wiljanen
(74) *Attorney, Agent, or Firm* — Pearne & Gordon LLP

(57) ABSTRACT

A marking implement comprises a main body (2) for housing a marking element (3) that is movable by sliding therein; the main body (2) comprises a broad grip portion (4) and an elongated neck (5) axially contiguous to the grip portion (4); a mechanism for sliding (7) said marking element (3), a protective cap (6) housing the neck (5) completely therein and the broad grip portion (4) at least partially. The sliding mechanism (7) comprises a movement slider (8) that is slidable axially and in a controlled manner along the main housing body (2) so as to guide the advancement and retraction of the marking element (3).

20 Claims, 7 Drawing Sheets

(56) References Cited

U.S. PATENT DOCUMENTS

| | | | | | |
|---|---|---|---|---|---|
| 1,677,387 | A * | 7/1928 | Gaidos | 401/89 | |
| 1,861,466 | A | 6/1932 | Bafetti | | |
| 2,463,345 | A * | 3/1949 | Youngquist | 401/83 | |
| 2,968,849 | A * | 1/1961 | Cain | 24/11 CT | |
| 4,659,242 | A * | 4/1987 | Katz | 401/85 | |
| 5,944,435 | A * | 8/1999 | Chai | 401/82 | |
| 6,264,389 | B1 * | 7/2001 | Ducharme | B43K 23/08 | 401/107 |
| 6,755,584 | B2 * | 6/2004 | O'Brien | B43K 25/02 | 401/109 |
| 7,172,359 | B2 * | 2/2007 | Mock | B43K 8/022 | 401/202 |
| 7,377,708 | B2 * | 5/2008 | Hageman | B43K 23/008 | 401/131 |
| 2011/0038659 | A1 * | 2/2011 | Andochick | 401/48 | |

* cited by examiner

MARKING IMPLEMENT

The object of the present invention is a marking implement, particularly of the type utilized in do-it-yourself home repairs and bricolage, in industry and in building yards, road construction sites and the like for marking walls, roads, trees or more in general, objects and/or surfaces of any type that have to be marked with suitable references or indications so as to be able to carry out manual work with specific technical instruments. Specifically, the implement constituting the object of the present invention relates to a depth marker, thus such as to be easily utilized for making marks on the surfaces cited through holes or cavities.

There are known depth markers exhibiting a main body having a sufficiently broad and extensive handgrip portion and an elongated and slender neck, which is useful for being inserted inside the above-mentioned holes or cavities as well.

The markers are also provided with a protective cap, which is often equipped with a retaining clip that allows for clipping the marker inside a breast pocket, on a notepad or on work overalls.

Markers such as these have an ink, pastel crayon, chalk or lead pencil supply system.

More specifically, known lead pencil depth markers are essentially conventional mechanical pencils, thus having a central body inside of which a lead is inserted.

The simplest mechanical pencils comprise a lead advance system consisting of a clutch and a spring. By pressing the button located at one end of the mechanical pencil, the opening of the clutch is simply brought about, which releases the grip on the lead for as long as the button is pressed. The lead is thus free to slide and be extracted to the desired length: with one hand the button is pressed and with the other, the length of the lead is adjusted.

Likewise, to retract the lead, the button is kept pressed with one hand, while pushing the lead with the other, either with the aid of a striking surface or by positioning the mechanical pencil vertically and letting the lead drop inside of it by the force of gravity.

A more advanced and technically more complicated version comprises the presence of a barrel inside the main body and defining a guide channel inside of which the lead slides.

The barrel also functions as a protective sleeve for the lead and it keeps it from breaking in the event of accidental impact affecting the marking implement.

Made of flexible plastic material, the barrel is constrained inside the neck of the main body, fitted at the elongated neck from which the lead for writing exits.

The lead is advanced by means of a snap-fitting mechanism, which comprises a button inserted at one end of the main body, at the end opposite the tip from which the writing lead exits, and it is press-fitted on the free end of the barrel.

By means of a complex mechanism comprising not only clutches and springs, but also fastening clamps and rings that must cooperate in synchrony and with precision, each click of the button brings about the discrete, calibrated and precise advancement of the lead. Therefore, in order for the lead to project out, the push-button must be repeatedly pressed for a sufficient number of times to have the lead advance to the desired length. For the lead to project out, it is thus sufficient to use only one hand, pressing, as mentioned, the snap-fitting button a certain number of times.

However, to retract the lead following use of the marker, the snap-fitting-button must be kept pressed with one hand, while pushing the lead inside at the same time with the other hand or with the aid of a striking surface.

The cap may also have a sharpener, located at the end opposite the end through which the main body is inserted, and the opening of which for insertion of the lead to be sharpened is afforded precisely at the tip of the cap.

As is apparent from this description, pencil depth markers of the type described hereinabove have several drawbacks.

In particular, it should be pointed out that these markers are structurally complicated to realize, requiring several moulds and therefore numerous components to be assembled, in a manner that is also not of insignificant importance, considering for example even just the complex snap-fitting mechanism for advancing the lead.

Moreover, they are made of different materials, among which metals and various types of plastic: all of which further increases production costs, obviously in addition to the complexity of the structure thereof.

Furthermore, the snap-fitting mechanism for advancing the lead renders the use of the marker itself not very practical and quite slow, given that the button must be pressed numerous times in order to bring the lead to the desired length of extraction. This inevitably slows down the work of the user. Likewise, retraction of the lead is just as awkward as it requires the use of both hands, or in any case, the use of one hand and a striking surface. In addition, it should be noted that it is not possible to reclose the main body inside the protective cap with the lead being partially extracted, given that in this case, the tip of the lead would abut against the bottom of the cap, hindering proper coupling and overlapping of two corresponding portions present on the main body and inside the cap, respectively, and suitable for interacting and coupling by pressure or snap-fitting. Therefore, in this case, the main body would not remain engaged inside the cap, with the risk of slipping off, accidentally falling and breaking the lead as a result.

According to the Applicant, various aspects of the known marking implement described hereinabove can be improved.

In particular, the aim of the present invention is to overcome the limits and the drawbacks described above with reference to the prior art.

More specifically, the aim of the invention is to offer a marking implement that is simple in terms of structure and easy to realize and assemble in terms of construction.

A further aim of the invention is to realize a marking implement that is practical, convenient, quick, immediate and easy to use even with just one hand, with a simple and rapid gesture and without further aid on the part of striking surfaces.

Furthermore, an aim of the present invention is to propose a marking implement that also proves to be economical and made with simple materials that are as homogeneous as possible.

These and other aims are substantially reached, according to the present invention, by realizing a marking implement comprising a main body for housing a marking element, such as a lead, that is movable by sliding therein, and comprising a broad grip portion and a slender elongated end portion axially contiguous to the grip portion, a protective cap housing the slender end portion completely therein and the broad grip portion at least partially, and a mechanism for sliding the marking element comprising a movement slider that can be activated manually and is slidable axially and in a controlled manner along the main housing body so as to guide the advancement and retraction of the marking element in a continuous manner.

More specifically, the object of the present invention is a marking implement comprising the characteristics stated in claim 1 and/or in one or more of the claims that follow.

Further characteristics and advantages of the invention will emerge more clearly from the detailed description of a preferred, but not exclusive, embodiment of a marking implement according to the present invention.

This description is set forth herein below with reference to the accompanying drawings, which are provided solely by way of non-limiting example, in which:

FIG. 1*a* is a perspective view of a marking implement according to the present invention and according to a preferred configuration;

FIG. 1*b* is a perspective view of a marking implement according to the present invention, according to an alternative configuration;

Figure 5C:
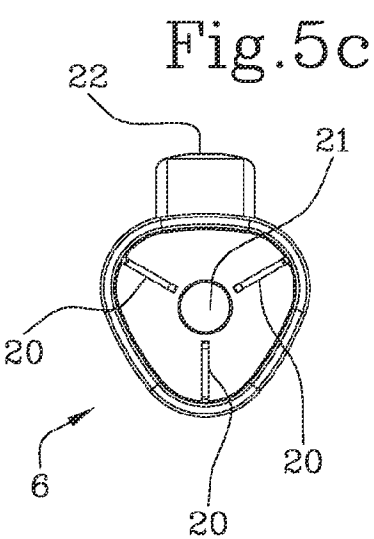
Figure 5A:
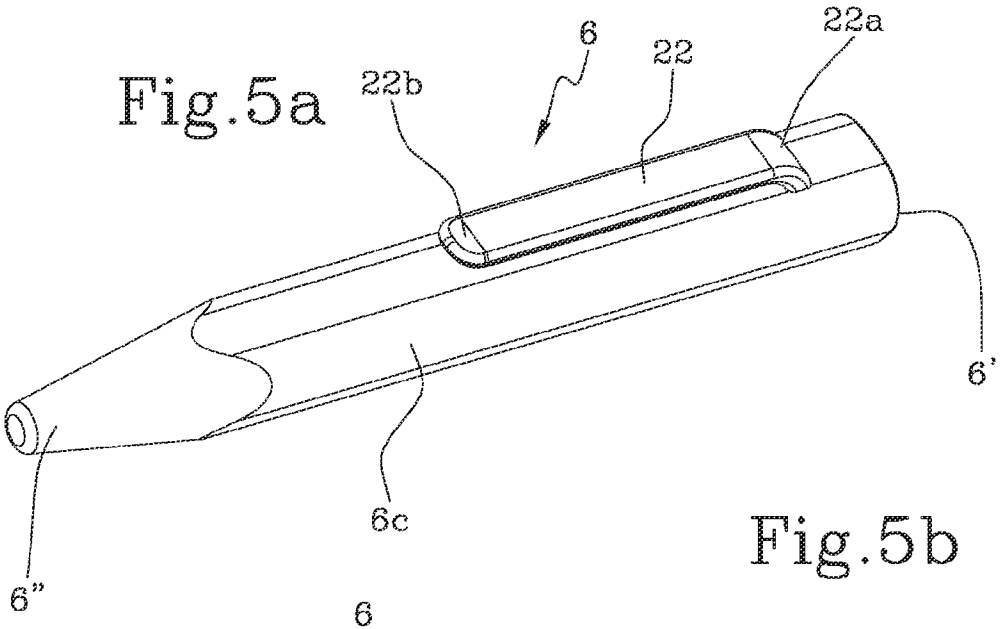
Figure 5B:
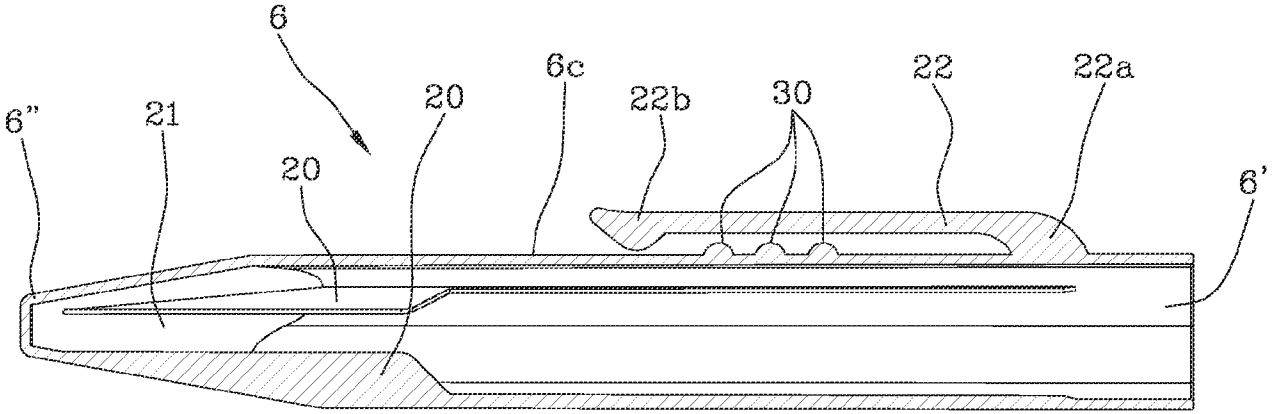

FIG. 5*a* is a perspective view of a protective cap of the marking implement, according to the preferred configuration;

FIG. 5*b* is a sectional side view, along a longitudinal plane, of the protective cap illustrated in FIG. 5*a;*

FIG. 5*c* is a rear view of the protective cap illustrated in FIG. 5*a;*

Figures 6A, 6B, 6C:
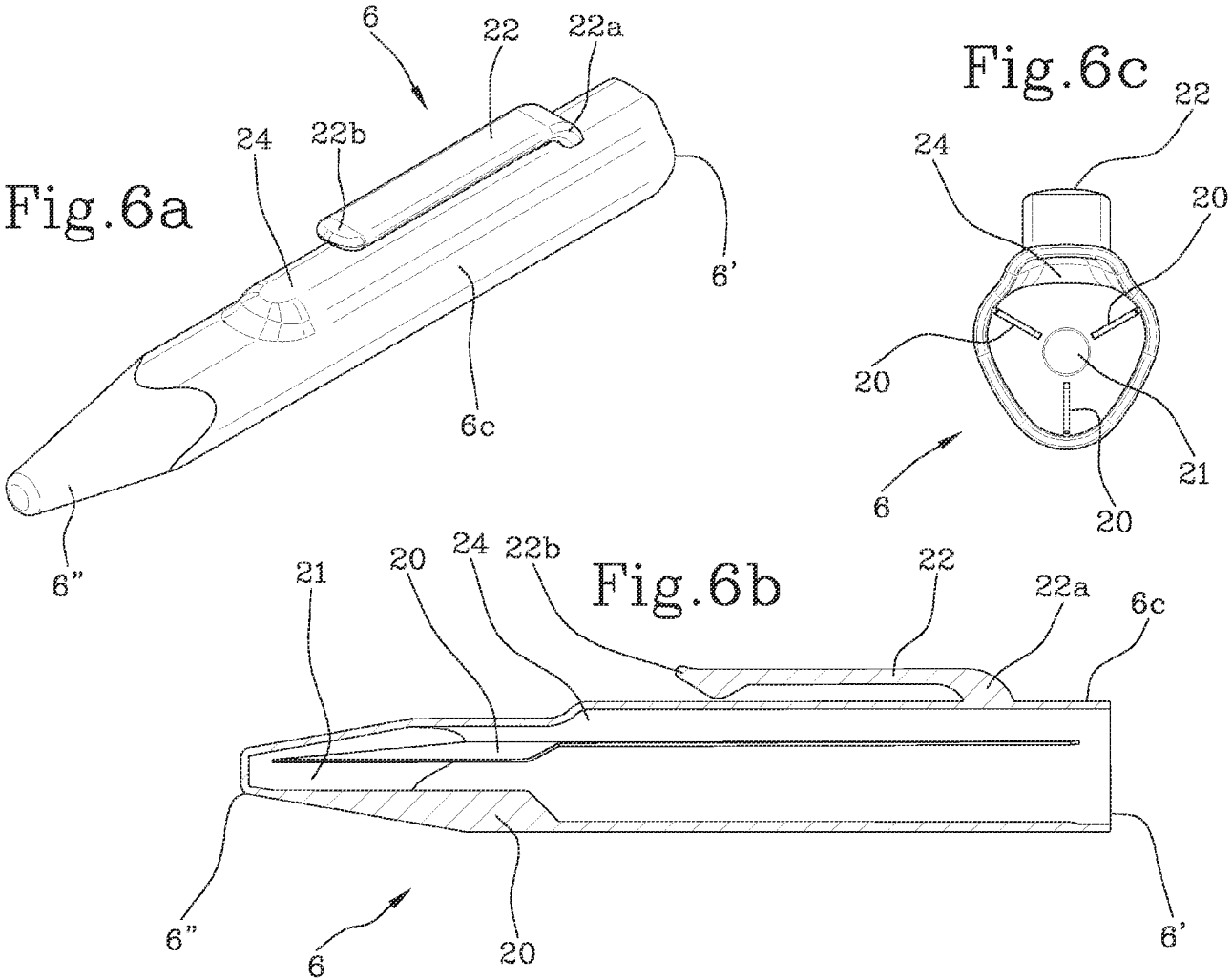

FIG. 6*a* is a perspective view of a protective cap of the marking implement, according to an alternative configuration;

FIG. 6*b* is a sectional side view, along a longitudinal plane, of the protective cap illustrated in FIG. 6*a;*

FIG. 6*c* is a rear view of the protective cap illustrated in FIG. 6*a;*

Figure 7:
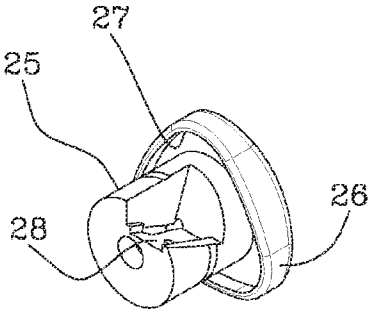
Figure 8:
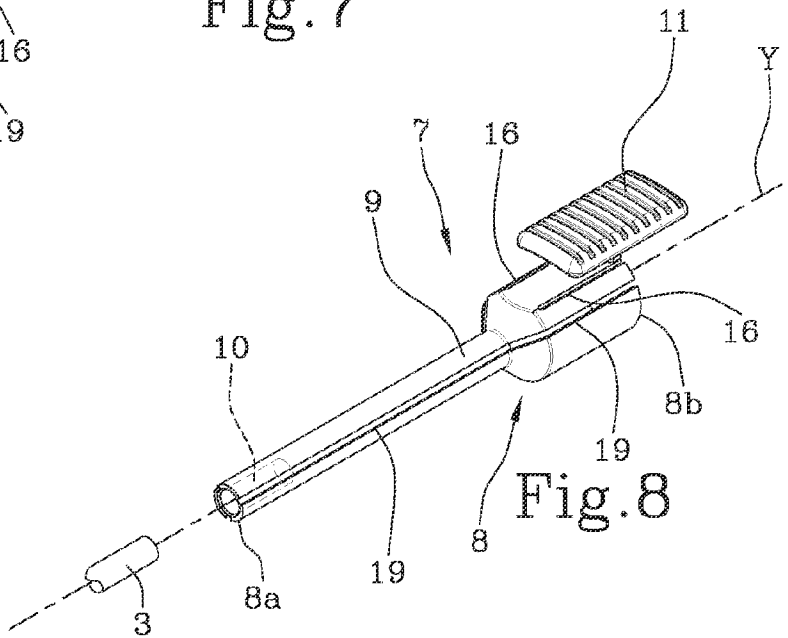
Figure 9:
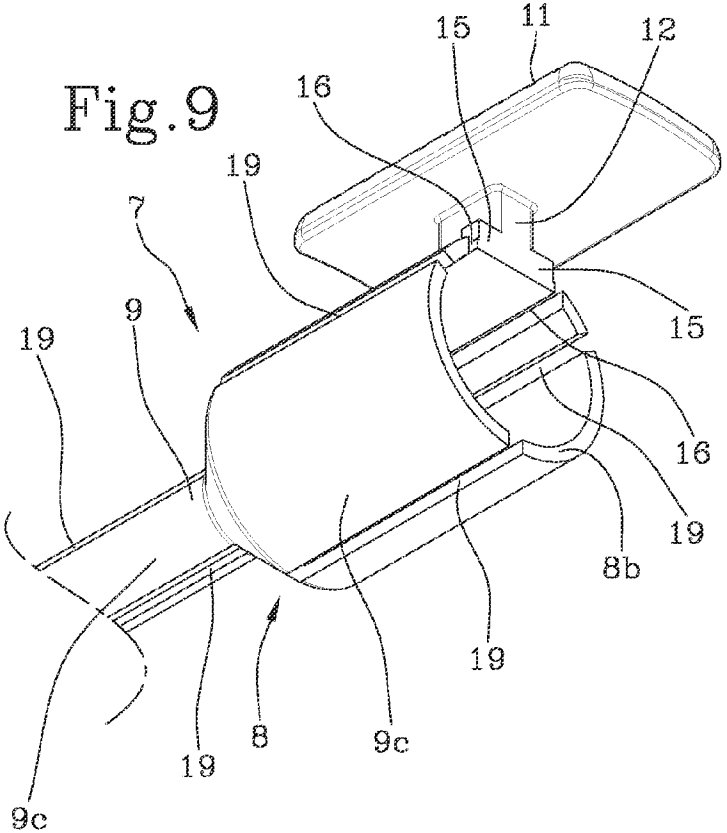
Figure 10:
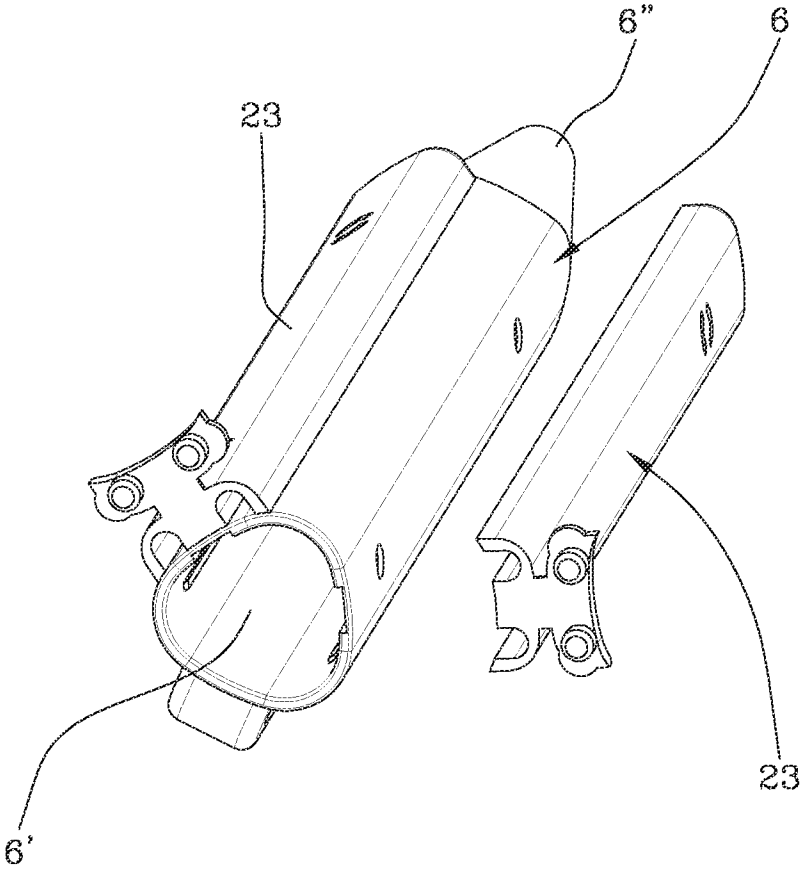

FIG. 7 is a perspective view of a sharpener present in the marking implement according to the present invention;

FIG. 8 is a perspective view of an internal part of the marking implement according to the present invention;

FIG. 9 is an enlarged view of a view from below of the part illustrated in FIG. 8;

FIG. 10 is a perspective view of an accessory that is coupleable to the main body of the marking implement according to the present invention.

With reference to the figures cited, a marking implement according to the present invention is indicated in its entirety by 1.

The implement 1 comprises a main body 2 for housing a marking element 3 that is slidingly movable therein. A marking element 3 is intended as any solid writing instrument that is consumable and replaceable, such as pencil leads, wax crayon, chalk or charcoal leads.

For the sake of convenience and practicality, specific and explicit reference shall be made hereinafter in this description only to markers that utilize pencil leads as the marking element, without this being intended as excluding the possibility of utilizing the other types cited above as marking elements as alternatives and just as easily.

Figure 1A:
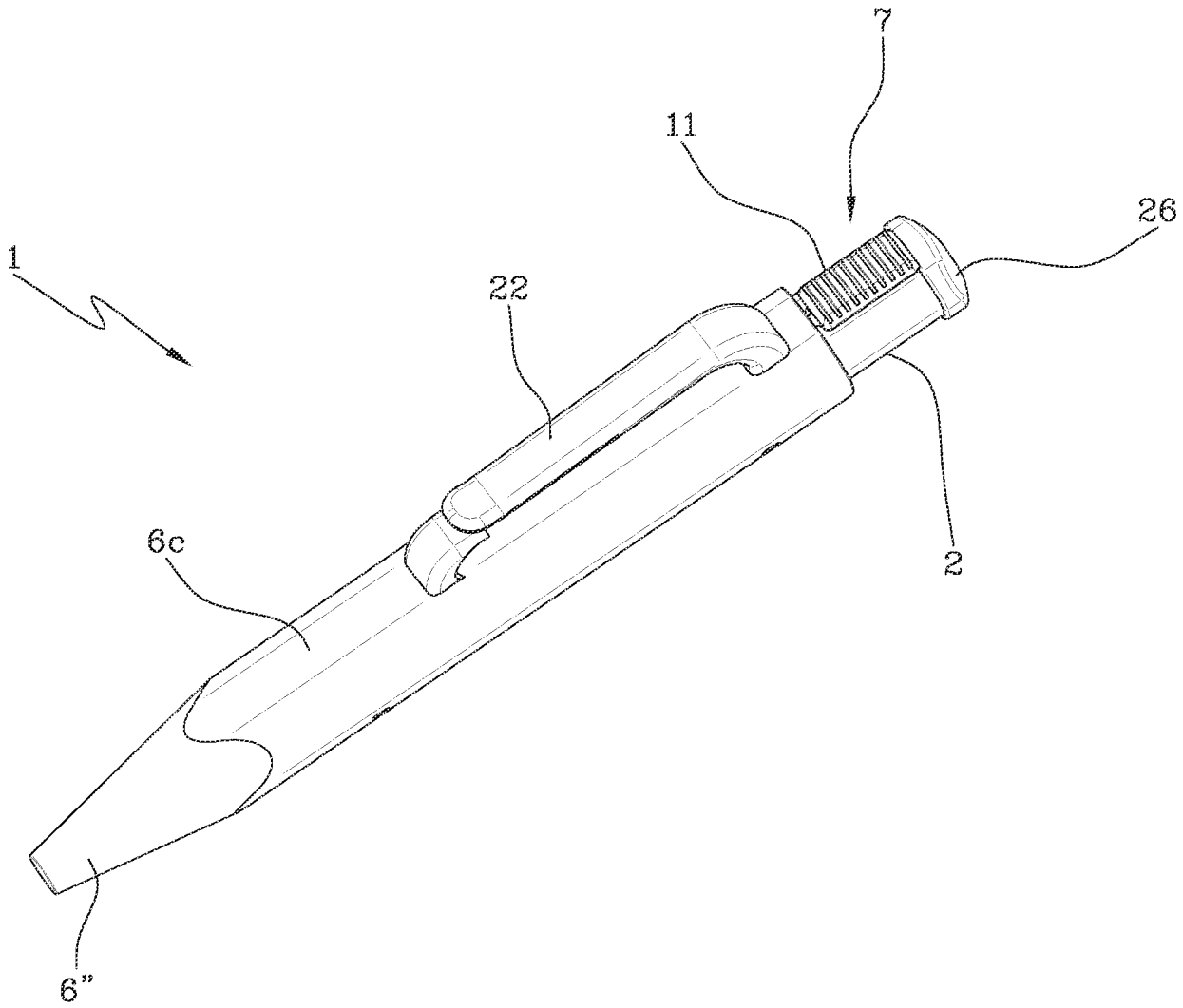
Figure 1B:
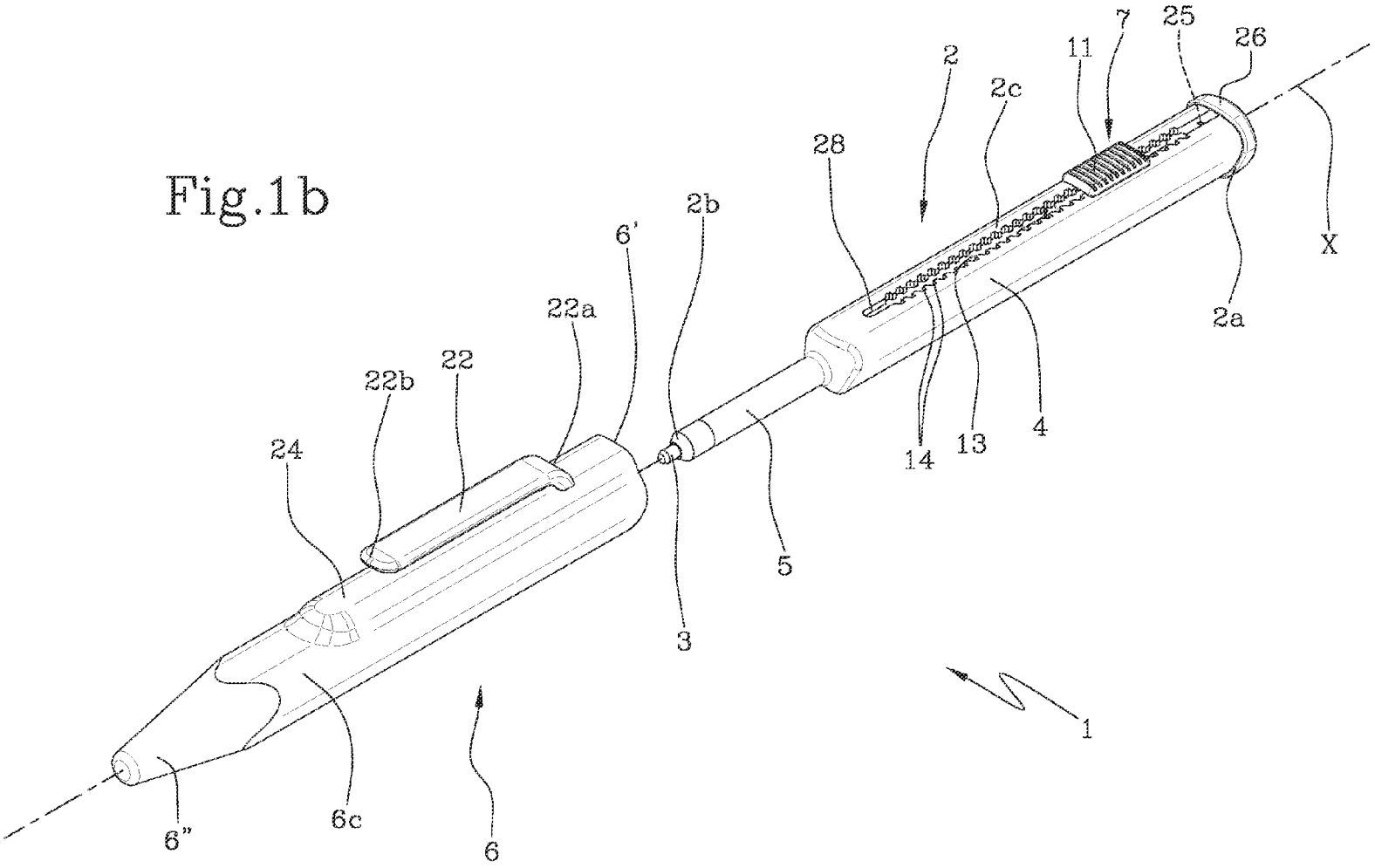
Figure 2:
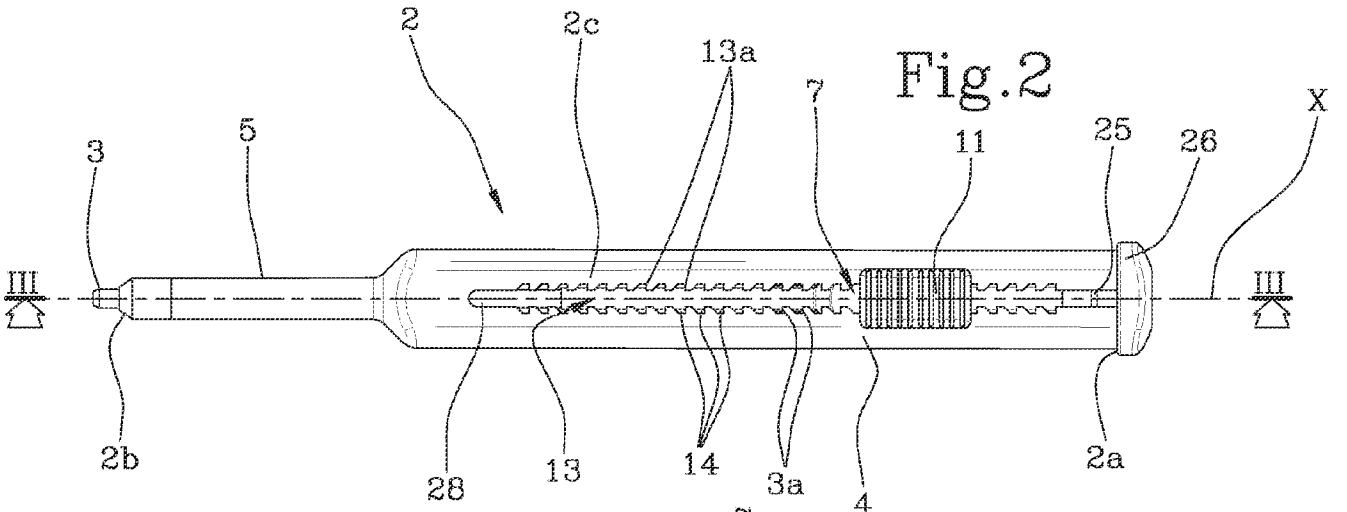
FIG. 2 is a perspective view of the main body of the marking implement according to the present invention.
Figure 4:
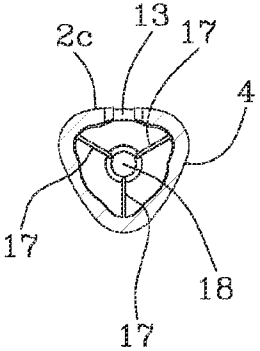
FIG. 4 is a sectional view, along a transverse plane IV-IV, of the main body illustrated in FIG. 2.

As can be seen in FIGS. 1*b* and 2, the main body 2 has a prevalently longitudinal extension along an axis X and comprises a broad and extensive grip portion 4 for the purpose of enabling easy gripping of the marker, and an elongated neck 5 that is axially contiguous to the grip portion 4. The neck 5 is thinner in cross-section than the grip portion 4 and measured along the axis X, the length of the neck ranges between one-fifth and one-third of the overall length of the main body 2, preferably being equal to about one-fourth.

The broad grip portion 4 preferably has a substantially triangular cross-section that also provides good ergonomics and easy gripping. However, other possible geometries are not excluded.

The neck 5, on the other hand, preferably has a circular cross-section, following the geometry of the lead. Yet, in this case as well, other geometries are not excluded; for example, a squared geometry in the event of use with chalk leads having a square cross-section.

The main body 2 is hollow inside and has a first end 2*a*, or bottom, and a second end 2*b*, or tip, both of which are perforated and in fluid communication with the interior. The first end 2*a* is situated at the free end of the grip portion 4, thus opposite the end from which the neck 5 extends, whereas the second end 2*b* or tip is found at the free end of the neck 5 from which the lead 3 exits.

The bottom 2*a* of the main body 2 is closed with a small end cap 26 from which a sharpener 25 projects out centrally, as illustrated in FIG. 7. The sharpener 25 is retractable inside the main body 2, whereas the end cap 26 is fitted by pressing on the first end 2*a*. Along its perimeter, the end cap has an undercut 27 that overlaps the edges of the first end 2*a* of the main body 2. The sharpener 25 is manually extractable by grasping the end cap 26. The end cap 26 and sharpener 25 are preferably made as one piece from the same mould; a steel blade 28 is then mounted on the sharpener 25 and fastened with a self-tapping screw. However, it is not excluded that the end cap 26 and the sharpener 25 may be made separately and then assembled later.

The marking implement 1 further comprises a protective cap 6 or sleeve that can be fitted on the main body 2 and comprises a first, open end 6' through which the main body 2 is inserted, and a second, opposite end 6".

The second end 6" may be closed or have one or more holes so as to prevent the cap from accidentally filling with water if used outdoors and/or to enable airflow inside the cap, with the mechanical pencil inserted, which makes it possible to maintain the specific characteristics of the lead.

Specifically, the protective cap 6 houses the entire neck 5 completely within its interior and at least partially the broad grip portion 4.

Figure 3:
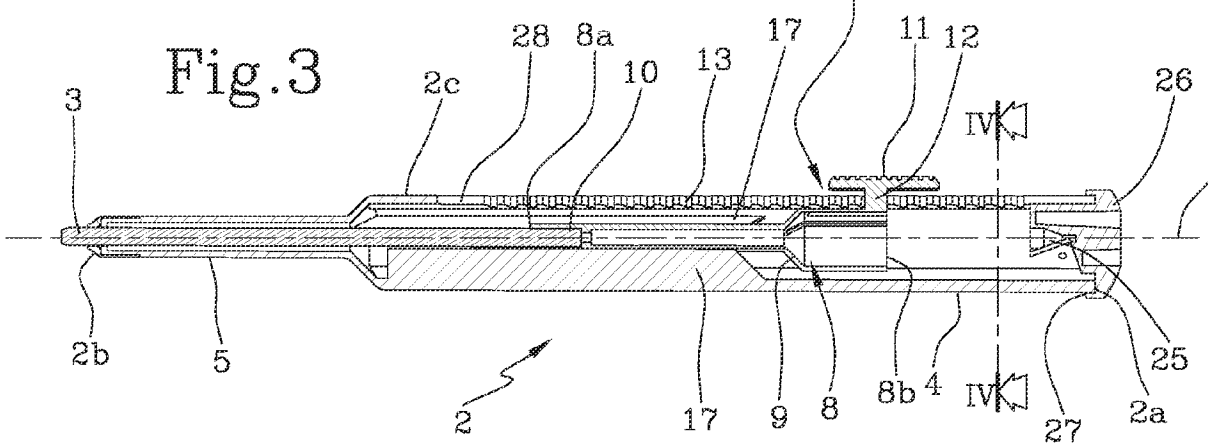
FIG. 3 is a sectional view, along a longitudinal plane III-III, of the main body illustrated in FIG. 2.

The implement 1 further exhibits a mechanism for sliding 7 the marking element 3, and comprising a movement slider 8 (clearly visible in FIGS. 3, 8 and 9) that is slidable axially and in a controlled manner along the main housing body 2 so as to guide the advancement and retraction of the lead in a continuous manner.

In other words, the movement mechanism 7 enables continuous advancement of the slider, and thus of the lead, from a position of non-use, in which the lead 3 is completely retracted and contained within the main body 2, to the position of use, in which the lead 3 is partially or completely extracted from the main body 2.

As is observable in FIGS. 8 and 9, the movement slider 8 comprises a fastening support 9 to which the lead is fixed, removably, by press-fitting it inside a slot 10 afforded at first end 8*a* of the slider 8.

This slot varies between 5 and 10 mm in depth, as measured along the axis X.

At a second end 8*b*, the slider 8 has a sliding button 11, extending in height from the fastening support 9, through a connecting portion 12, for manual activation of the slider 8. The sliding button 11 is made in a single mould with the fastening support 9, which has, in the proximity of the connecting portion 12, two through slits 16 that are longitudinal and parallel to the main axis of extension Y of the slider 8. The presence of these slits 16 makes the sliding button 11 elastically deformable and it can thus be pressed radially toward the axis Y of the slider 8 and, when released, return on its own to the rest position.

The sliding mechanism 7 further comprises, along a lateral surface 2*c* of the main body 2, and more specifically of the broad grip portion 4, a guide 13 that passes through the lateral surface 2*c*, parallel to the longitudinal axis X. The movement slider 8 is axially slidable along this guide 13; in particular, the fastening support 9 is internally slidable in the main body 2 along the axis X, the sliding button 11 is externally slidable of the main body 2, and the connecting portion 12 between the button 11 and the support 9 slides through the guide 13.

The guide 13 comprises a plurality of grooves 14, which extend transverse to the rectilinear longitudinal extension of the guide 13 and are aligned along the axis X.

The connecting portion 12 between the button 11 and the lead-fastening support 9 comprises at least one small tooth 15, which projects out laterally for engagement in one of the grooves 14. Advantageously, there are two teeth 15 per side, and therefore the series of grooves 14 axially aligned along the guide 13 is symmetrical with respect to the axis X, so as to enable engagement of both teeth 15.

The engaging of the teeth 15 and the grooves 14 makes it possible to lock the movement slider 8 in a given position along the guide 13, thus keeping the marking element 3 in the desired configuration, extracted more or less from the neck 5 of the main body 2. In fact, each groove 13 creates a shoulder 13*a* so as to serve as an abutment for the respective tooth 15.

To enable sliding of the lead, for extraction or retraction, the user uses the sliding button 11, which, as mentioned above, is elastically deformable, by exerting light radial pressure, then pressing downward as if to make the button 11 re-enter inside the main body 2.

The pressure on the button 11 causes the teeth 15 to descend under the groove 13 and the consequent disengagement of the teeth 15 from the corresponding grooves 14, in which they are stably engaged. Following this disengagement, only the connecting portion 12 is found along the groove 13 and as it extends transversely less than the teeth 15, it passes along the groove 13 without interfering, thus enabling fluid and continuous advancing and retracting movement of the slider 8 and thus of the lead 3.

The groove 13 extends from the first end 2*a* toward the second end 2*b*, and ends slightly before the beginning of the neck 5. The groove 13 thus opens toward the exterior, permitting insertion of the slider, through the first open end 2*a*, inside the central body 2 straddling the same groove 13. The closure end cap 26 with the sharpener 25 prevents the slider 8 from slipping off this first end 6'.

The end section 28 of the groove 13, that is, the one closest to the neck 5, has no lateral grooves 14. This allows for advancement of the movement slider 8 as far as the end stop for removal of the last stub of lead and replacement with a new lead 3. The absence of the grooves 13 avoids, conjointly, the locking of the slider 8 in the end stop position, so as to prevent use of the implement with a lead that is almost completely used up, under a certain length. In fact, excessive use of the marking element, until almost reaching the level of the first end 8*a* of the slider 8, could lead to several problems related to the replacement of the latter.

The absence of the locking grooves 13 thus enables re-entry of the slider 8 as far as the first row of grooves 13 with which the teeth 15 are able to engage, thus by a section such as to enable use of the lead only up to a predetermined length.

When the teeth 15 are engaged with the last row of grooves 13 closest to the neck 5 and the lead does not exit from the neck 5, it means that the lead needs replacement. At this point, the slider 8 can be advanced as far as the end stop, the stub of lead comes out of the neck 5 and it is possible to proceed with replacement of the lead.

Inside the broad grip portion 4, the main body 2 has at least three radial tabs 17 that are angularly equidistant and suitable for defining and delimiting a central axial channel 18, for passage of the lead 3. These tabs 17 only extend for one section of the axial extension of the grip portion 4, particularly from midpoint of the grip portion 4 toward the neck 5.

The tabs 17 lightly touch and guide the lead along its sliding course, ensuring the axial alignment thereof with the outlet hole for the neck 5, in addition to defining the protective edges that keep it locked in the axial position, protecting it from possible accidental impact.

In order to interact and slide proportionately between the tabs 17 cited, the fastening support 9 has, along an external lateral surface 9*c*, a number of longitudinal grooves 19, equal to the number of tabs 17. In this manner, the slider 8 can slide along the central channel 18, without the risk of accidentally rotating about the axis X during the axial movement, as the teeth 15 are also disengaged.

There are also at least three radial tabs 20 inside the protective cap 6 that are angularly equidistant and extend from the second end 6" toward the first end 6', only for part of the length of the cap 6, at least equal to the length of the neck 5.

In fact, the presence of the tabs 20 inside the protective cap 6 serves to reduce the free space so as to permit the definition of a housing compartment 21 proportional to the neck 5, in length and in the transverse dimension.

In fact, externally, the protective cap 6 does not follow the shape of the main body 2, that is, it does not have one broad portion and another portion that is very tapered like the neck 5, but it substantially has the shape of a large pencil, thus with a cross-section substantially remaining the same throughout almost all of its length, with only the tip, at the second end 6", being slightly tapered towards the end and exactly simulating that of a sharpened pencil with a slightly rounded tip.

On the external lateral surface 6*c* of the cap 6, there is a retaining clip 22 that has a first end 22*a* connected to the cap 6 and a second end 22*b* that is free.

The clip allows for anchoring the marker, and particularly the cap, inside pockets, on overalls or on folders or notepads.

To increase the grip in the case of clipping onto thin bodies such as the fabric of a breast pocket, one or more small bumps 30 can be provided on the external surface 6*c* of the cap 6, below the clip 22 (FIG. 5*b*).

The clip is preferably turned from the first end 6' of the cap toward the second end 6", in such a manner that the main body 2 faces upward and can thus be slipped off the cap 6 to be used, and repositioned inside the sleeve 6, without ever removing the latter from the clipping position.

The main body 2 is coupled to the cap 6 by means of a slight friction force or a small undercut ring that creates an interfering edge and thus a snap-fit closure.

In this manner the central body 2 is prevented from accidentally slipping off the closure cap 6.

An alternative configuration of the protective cap 6, illustrated in FIGS. 1*b*, 6*a*, 6*b* and 6*c*, comprises the presence of a seat 24 inside the same cap and suitable for receiving the sliding button 11 of the mechanical pencil when it is in the partially advanced position. This seat 24 is in an external protuberance of the cap 6, extending partially along the axial extension of the cap 6, from the first end 6' toward the second end 6", and located below the retaining clip 22, as shown in the figures mentioned.

The implement 1 may possibly have at least one holder 23 (shown in FIG. 10) that can be reversibly associated with the protective cap 6, so as to store at least one spare lead, preferably two spare leads.

Engagement between the loader 23 and sleeve 6 preferably takes place by reversible interference fit.

The invention achieves numerous advantages and the proposed aims.

In fact, the described marking implement is structurally very simple and made from a limited number of components that can be easily assembled together.

As concerns construction, the central body is preferably made in only one piece and therefore only requires one mould.

As an alternative, the neck can be made separately, in a more resistant material, for example metal, to prevent possible damage thereto resulting from it rubbing accidentally against the surfaces to be marked.

The described manual advancing mechanism is mechanically very simple and free of numerous complicated, delicate components that need to interact with each other.

Moreover, the advancing mechanism of the type described herein enables controlled and continuous movement of the slider, and therefore of the lead, during extraction and retraction thereof, thereby bringing the lead almost instantly to the desired extraction length without necessarily having to pass and transition through all of the intermediate positions between that of complete insertion in the main body and the position of complete extraction. With the movement mechanism described hereinabove, the lead can also be retracted just as quickly so as to set the implement back in the cap. Furthermore, the lead is moved using only one hand, without the need for additional aids. In the event that it is necessary to calibrate the length of lead extraction, as required, it is also possible to advance the lead gradually by small increments corresponding to the various grooves present along the guide. In fact, each groove corresponds to all the possible intermediate positions between that of complete retraction and that of complete extraction of the lead.

The implement can be completely disassembled and the lead can be easily replaced either from the tip of the main body or by slipping the slider off from the bottom of the central body, after removing the end cap with the sharpener.

The simplicity of the structure, the homogeneity of the materials, all of which are preferably plastic materials made with a very small number of moulds, and the ease of assembly make the described marking implement economical and easy to produce.

The invention claimed is:

1. A marking implement comprising a main body (2) for housing a marking element (3) that is movable by sliding therein, said main body (2) comprising a broad grip portion (4) and an elongated neck (5) axially contiguous to said grip portion (4); a mechanism for sliding (7) said marking element (3), a protective cap (6) housing the neck (5) completely therein and said broad grip portion (4) at least partially, characterized in that said sliding mechanism (7) comprises a movement slider (8) that is slidable axially and in a controlled manner along the main housing body (2) so as to guide the advancement and retraction of said marking element (3).

2. The implement according to claim 1, characterized in that said movement slider (8) comprises a fastening support (9) for said marking element (3), and a sliding button (11) for manual activation of said movement slider (8), and extending in height from said fastening support (9) through a connecting portion (12).

3. The implement according to claim 2, characterized in that said main body (2) comprises, along a lateral surface (2*c*) of said broad grip portion (4), a through guide (13) that is parallel to the longitudinal axis (X) of the implement.

4. The implement according to claim 3, characterized in that said fastening support (9) is slidable internally of said main body (2), said sliding button (11) is slidable externally of said main body (2), and said connecting portion (12) slides through said guide (13).

5. The implement according to claim 3, characterized in that said guide (13) comprises a plurality of grooves (14) transverse to the longitudinal extension of said guide (13), and aligned along said guide (13).

6. The implement according to claim 5, characterized in that said connecting portion (12) comprises at least one transverse tooth (15) that is engageable inside a respective groove (14) of said guide (13), so as to lock the movement slider (8) in a given position along the guide (13) and to keep the marking element in an extracted or partially extracted configuration, or completely inserted in said main body (2) as a result.

7. The implement according to claim 6, characterized in that said guide (13) comprises, in the proximity of the neck (5) of the main body (2), a section (28) without any of said grooves (14) that allows the movement slider (8) to advance up to the end for replacement of the marking element (3) and, conjointly, prevents the locking of the slider (8) at the end stop and use of the implement with the marking element (3) almost completely used up.

8. The implement according to claim 2, characterized in that said sliding button (11) is elastically deformable by exerting pressure thereon.

9. The implement according to claim 2, characterized in that internally of said broad grip portion (4) and for a partial extent of the axial extension thereof, said main body (2) has at least three radial tabs (17) that are angularly equidistant and delimit a central channel (18) for passage of the marking element (3), and characterized in that said fastening support (9) has, along an external lateral surface (9*c*) thereof, longitudinal grooves (19), where within each one a respective radial tab (17) slides, so as to enable said slider (8) to slide along said central channel (18).

10. The implement according to claim 1, characterized in that it comprises a manually extractable sharpener (25) at a first end (2*a*) of said main body (2), corresponding to an open end of said broad grip portion (4).

11. The implement according to claim 1, characterized in that said protective cap (6), having a first end (6') open for insertion of the main body and a second end (6") opposite to the first end, comprises, on its external lateral surface (6*c*), a retaining clip (22) having a first end (22*a*) connected to said cap (6) and a second end (22*b*) that is free and oriented towards the second end (6") of the cap (6), to anchor the marker cap (6) and to allow the main body (2) to be slipped off the cap (6) and repositioned inside the cap (6), without ever removing the latter from the clipping position.

12. The implement according to claim 1, characterized in that internally of said broad grip portion (4) and for a partial extent of the axial extension thereof, said main body (2) has at least three radial tabs (17) that are angularly equidistant and delimit a central channel (18) for passage of the marking element (3).

13. The implement according to claim 1, characterized in that said protective cap (6) has a first end (6') which is open for insertion of the main body and a second end (6"), opposite the first end; said protective cap (6) internally comprising at least three radial tabs (20) that are angularly equidistant and partially extend from said second end (6") toward said first end (6'), in such a manner as to define an internal channel (21) of a length at least equal to the length of the neck (5) of said main body (2) and having a cross-section at least equal to the transverse dimension of said neck (5).

14. The implement according to claim 1, characterized in that it comprises at least one holder (23) that can be reversibly associated with said protective cap (6), so as to store at least one spare marking element.

15. The implement according to claim 1, characterized in that said broad grip portion (4) and said protective cap (6) have a substantially polygonal cross-section.

16. The implement according to claim 15, wherein said substantially polygonal cross-section is a substantially triangular cross-section.

17. A marking implement comprising a main body (2) for housing a marking element (3) that is movable by sliding therein, said main body (2) extending prevalently along a longitudinal axis (X) and comprising a broad grip portion (4) and an elongated neck (5) axially contiguous to said grip portion (4); a mechanism for sliding (7) said marking element (3) and comprising a movement slider (8) that is slidable axially and in a controlled manner along the main housing body (2) so as to guide the advancement and retraction of said marking element (3), a protective cap (6) housing the elongated neck (5) completely therein and said broad grip portion (4) at least partially, wherein said elongated neck (5) presents a cross-section which is constant along the axial extension of the elongated neck (5) and which is thinner than a cross-section of said broad grip portion (4), wherein said elongated neck (5) presents a length, measured along the longitudinal axis (X), between one-fifth and one-third of the overall length of the main body (2).

18. A marking implement comprising a main body (2) for housing a marking element (3) that is movable by sliding therein, said main body (2) comprising a broad grip portion (4) and an elongated neck (5) axially contiguous to said grip portion (4); a mechanism for sliding (7) said marking element (3) and comprising a movement slider (8) that is slidable axially and in a controlled manner along the main housing body (2) so as to guide the advancement and retraction of said marking element (3), a protective cap (6) housing the neck (5) completely therein and said broad grip portion (4) at least partially, wherein said protective cap (6), having a first end (6') open for insertion of the main body and a second end (6") opposite to the first end, presents a retaining clip (22) having a first end (**22*a*) connected to the cap (6) and a second end (22*b*) that is free and oriented towards the second end (6") of the cap (6), to anchor the cap (6) and to allow the main body (2) to be slipped off the cap (6) and repositioned inside the cap (6**), without ever removing the latter from the clipping position.

19. A marking implement comprising a main body (2) for housing a marking element (3) that is movable by sliding therein, said main body (2) comprising a broad grip portion (4) and an elongated neck (5) axially contiguous to said grip portion (4); a mechanism for sliding (7) said marking element (3), a protective cap (6) housing the neck (5) completely therein and said broad grip portion (4) at least partially, said sliding mechanism (7) comprising a movement slider (8) that is slidable axially and in a controlled manner along the main housing body (2) so as to guide the advancement and retraction of said marking element (3) wherein internally of said broad grip portion (4) and for a partial extent of the axial extension thereof, said main body (2) has at least three radial tabs (17) that are angularly equidistant and defining a central channel (18) for passage of the marking element (3).

20. A marking implement comprising a main body (2) for housing a marking element (3) that is movable by sliding therein, said main body (2) comprising a broad grip portion (4) and an elongated neck (5) axially contiguous to said grip portion (4); a mechanism for sliding (7) said marking element (3), a protective cap (6) housing the neck (5) completely therein and said broad grip portion (4) at least partially, characterized in that said sliding mechanism (7) comprises a movement slider (8) that is slidable axially and in a controlled manner along the main housing body (2) so as to guide the advancement and retraction of said marking element (3), wherein internally of said broad grip portion (4) and for a partial extent of the axial extension thereof, said main body (2) has at least three radial tabs (17) that are angularly equidistant and delimit a central channel (18) for passage of the marking element (3), and characterized in that said fastening support (9) has, along an external lateral surface (**9*c*) thereof, longitudinal grooves (19), where within each one a respective radial tab (17) slides, so as to enable said slider (8) to slide along said central channel (18**).

* * * * *